US007987614B2

(12) United States Patent
Erickson

(10) Patent No.: US 7,987,614 B2
(45) Date of Patent: Aug. 2, 2011

(54) RESTRAINING DEVICE FOR REDUCING WARP IN LUMBER DURING DRYING

(76) Inventor: Robert W. Erickson, Minneapolis, MN (US)

( * ) Notice: Subject to any disclaimer, the term of this patent is extended or adjusted under 35 U.S.C. 154(b) by 138 days.

(21) Appl. No.: 11/100,710

(22) Filed: Apr. 7, 2005

(65) Prior Publication Data

US 2005/0223590 A1 Oct. 13, 2005

Related U.S. Application Data

(60) Provisional application No. 60/561,424, filed on Apr. 12, 2004.

(51) Int. Cl.
*F26B 19/00* (2006.01)

(52) U.S. Cl. ..... 34/396; 34/518; 34/381; 34/90; 34/210; 34/218; 100/50; 52/641; 52/79.12; 144/347; 297/284.1; 297/284.4; 705/14; 264/255; 264/135

(58) Field of Classification Search ..... 34/518, 34/381, 90, 210, 218, 380, 396; 100/50; 52/641, 79.12; 144/347; 297/284.1, 284.4; 705/14; 264/255, 135
See application file for complete search history.

(56) References Cited

U.S. PATENT DOCUMENTS

| | | | | | |
|---|---|---|---|---|---|
| 620,114 | A | * | 2/1899 | Ferrell | 427/372.2 |
| 620,869 | A | * | 3/1899 | Horton | 100/34 |
| 772,157 | A | * | 10/1904 | Koehler | 74/156 |
| 1,197,097 | A | * | 9/1916 | Banks | 34/350 |
| 1,212,583 | A | * | 1/1917 | Tanner | 34/380 |
| 1,260,921 | A | * | 3/1918 | Leissner | 267/69 |
| 1,333,848 | A | * | 3/1920 | Jacobs | 34/411 |
| 1,439,227 | A | * | 12/1922 | Cochran | 414/740 |
| 1,506,649 | A | * | 8/1924 | Lotte | 248/499 |
| 1,563,650 | A | * | 12/1925 | Pleines | 414/622 |
| 1,578,020 | A | * | 3/1926 | Elmendorf | 34/389 |
| 1,610,117 | A | * | 12/1926 | Black | 101/125 |

(Continued)

FOREIGN PATENT DOCUMENTS

DE 3607352 A1 * 9/1987

(Continued)

OTHER PUBLICATIONS

"Press-drying plantation loblolly pine lumber to reduce warp: follow-up studies", W. Simpson et al., *Forest Products Journal*, vol. 42(5), May 1992, p. 65-69.

(Continued)

*Primary Examiner* — Stephen M. Gravini
(74) *Attorney, Agent, or Firm* — Westman, Champlin & Kelly, P.A.

(57) ABSTRACT

The present invention relates to an apparatus and processing method for drying lumber, for example two-by-four studs in an environment in a kiln in a manner to avoid warping, including crook, bow, cup and twist. The lumber pieces are stacked in a normal manner with stickers for providing air flow between courses of the lumber pieces, and the stack is dried while a horizontal force is provided to the respective courses of lumber in the stack to hold the individual pieces of lumber in edge to edge contact throughout the drying, equalizing, conditioning and cooling process for first drying of lumber, redrying of lumber or in a treatment process for removing warp from previously dried lumber. A vertical force comprising a weight or other force generating device can be also applied to the stack of lumber to augment the overall reduction in warpage if so evidenced.

21 Claims, 6 Drawing Sheets

U.S. PATENT DOCUMENTS

| | | | | | |
|---|---|---|---|---|---|
| 1,624,754 | A | * | 4/1927 | Mueller | 34/513 |
| 1,670,673 | A | * | 5/1928 | Williams | 396/621 |
| 1,672,326 | A | * | 6/1928 | Kobiolke | 422/28 |
| 1,680,013 | A | * | 8/1928 | Cobb | 34/223 |
| 1,687,822 | A | * | 10/1928 | Babel | 34/467 |
| 1,693,395 | A | * | 11/1928 | Lawton | 34/143 |
| 1,746,919 | A | * | 2/1930 | White | 100/154 |
| 1,774,208 | A | * | 8/1930 | Mueller | 34/191 |
| 1,778,079 | A | * | 10/1930 | Kristensson | 34/403 |
| 1,785,484 | A | * | 12/1930 | Kastner et al. | 34/246 |
| 1,878,994 | A | * | 9/1932 | Abbe | 414/620 |
| 1,893,497 | A | * | 1/1933 | Gray | 34/311 |
| 1,972,346 | A | * | 9/1934 | Juline | 24/270 |
| 1,981,417 | A | * | 11/1934 | Kreutzer | 119/449 |
| 1,990,554 | A | * | 2/1935 | Libberton | 264/345 |
| 2,017,728 | A | * | 10/1935 | Oskamp | 34/197 |
| 2,050,226 | A | * | 8/1936 | Krick | 34/191 |
| 2,050,626 | A | * | 8/1936 | Otis | 34/222 |
| 2,060,515 | A | * | 11/1936 | McConnell | 34/540 |
| 2,095,319 | A | * | 10/1937 | Drake | 34/518 |
| 2,101,042 | A | * | 12/1937 | Casey | 210/396 |
| 2,136,880 | A | * | 11/1938 | Honigman | 198/465.3 |
| 2,181,356 | A | * | 11/1939 | Chipman | 211/49.1 |
| 2,199,827 | A | * | 5/1940 | Skinner | 15/3.17 |
| 2,247,519 | A | * | 7/1941 | Pace | 211/49.1 |
| 2,296,546 | A | * | 9/1942 | Toney | 34/411 |
| 2,326,115 | A | * | 8/1943 | Arthur | 34/226 |
| 2,336,110 | A | * | 12/1943 | Matteson et al. | 34/107 |
| 2,346,176 | A | * | 4/1944 | McAleer | 34/500 |
| 2,366,779 | A | * | 1/1945 | Gaumer | 241/47 |
| 2,373,374 | A | * | 4/1945 | Bierwirth | 536/56 |
| 2,387,595 | A | * | 10/1945 | Krupnick et al. | 34/257 |
| 2,448,288 | A | * | 8/1948 | Alk | 100/278 |
| 2,453,033 | A | * | 11/1948 | Patterson | 34/76 |
| 2,511,876 | A | * | 6/1950 | Protzeller | 62/186 |
| 2,515,828 | A | * | 7/1950 | Jarmain | 34/442 |
| 2,538,888 | A | * | 1/1951 | Smith | 34/223 |
| 2,548,403 | A | * | 4/1951 | Smith | 34/191 |
| 2,559,107 | A | * | 7/1951 | Bloxham | 34/370 |
| 2,560,763 | A | * | 7/1951 | Griffith, Jr. | 34/255 |
| 2,561,098 | A | * | 7/1951 | Cole | 296/182.1 |
| 2,570,757 | A | * | 10/1951 | Bowman et al. | 414/802 |
| 2,573,217 | A | * | 10/1951 | Parmelee | 34/105 |
| 2,618,813 | A | * | 11/1952 | Patton et al. | 264/120 |
| 2,620,769 | A | * | 12/1952 | Ornitz | 118/423 |
| 2,634,117 | A | * | 4/1953 | Bloxham | 432/61 |
| 2,643,956 | A | * | 6/1953 | Kuebler et al. | 427/67 |
| 2,651,101 | A | * | 9/1953 | Clemons | 29/25.42 |
| 2,702,435 | A | * | 2/1955 | Pinney | 34/105 |
| 2,755,832 | A | * | 7/1956 | Muller | 100/322 |
| 2,758,461 | A | * | 8/1956 | Tann | 68/19.1 |
| 2,803,888 | A | * | 8/1957 | Cerletti | 34/62 |
| 2,821,029 | A | * | 1/1958 | Simons | 34/487 |
| 2,830,382 | A | * | 4/1958 | Petersen | 34/546 |
| 2,832,157 | A | * | 4/1958 | Hudson | 34/90 |
| 2,875,913 | A | * | 3/1959 | Gohrke et al. | 414/622 |
| 2,880,524 | A | * | 4/1959 | Hiller et al. | 34/102 |
| 2,929,674 | A | * | 3/1960 | Tann | 8/159 |
| 2,940,613 | A | * | 6/1960 | Prentice et al. | 414/783 |
| 2,942,867 | A | * | 6/1960 | Rumsey | 267/120 |
| 2,947,654 | A | * | 8/1960 | Chapman | 162/104 |
| 2,953,805 | A | * | 9/1960 | Sevenich | 15/310 |
| 2,959,870 | A | * | 11/1960 | Vandercook | 34/619 |
| 2,969,038 | A | * | 1/1961 | Neumann | 366/101 |
| 2,971,237 | A | * | 2/1961 | Graham | 249/33 |
| 3,001,298 | A | * | 9/1961 | Blesch et al. | 34/212 |
| 3,027,031 | A | * | 3/1962 | Woodward et al. | 414/620 |
| 3,091,002 | A | * | 5/1963 | Nicholson | 52/641 |
| 3,095,678 | A | * | 7/1963 | Cliff et al. | 53/529 |
| 3,103,422 | A | * | 9/1963 | Green | 34/238 |
| 3,119,637 | A | * | 1/1964 | Eaves | 294/67.22 |
| 3,133,655 | A | * | 5/1964 | Gardner | 414/620 |
| 3,135,589 | A | * | 6/1964 | Stokes | 34/73 |
| 3,155,030 | A | * | 11/1964 | Curtis | 100/194 |
| 3,169,157 | A | * | 2/1965 | Harris | 432/64 |
| 3,198,871 | A | * | 8/1965 | Westeren et al. | 373/111 |
| 3,212,198 | A | * | 10/1965 | Strube | 34/124 |
| 3,249,737 | A | * | 5/1966 | Casebeer | 219/205 |
| 3,252,609 | A | * | 5/1966 | Ellis | 414/620 |
| 3,256,617 | A | * | 6/1966 | Konstandt | 34/661 |
| 3,259,991 | A | * | 7/1966 | Illich, Jr. | 34/289 |
| 3,271,874 | A | * | 9/1966 | Oppenheimer | 34/292 |
| 3,271,877 | A | * | 9/1966 | Guenther, Jr. et al. | 34/543 |
| 3,279,759 | A | * | 10/1966 | Tallman | 24/68 CD |
| 3,283,412 | A | * | 11/1966 | Farnsworth | 34/287 |
| 3,310,653 | A | * | 3/1967 | Crockett | 219/388 |
| 3,324,571 | A | * | 6/1967 | Stock | 34/653 |
| 3,337,174 | A | * | 8/1967 | Kreibaum | 206/321 |
| 3,339,287 | A | * | 9/1967 | Gray | 34/444 |
| 3,396,099 | A | * | 8/1968 | Glinka | 208/107 |
| 3,399,460 | A | * | 9/1968 | Russell | 34/255 |
| 3,404,788 | A | * | 10/1968 | Thomas et al. | 414/789.5 |
| 3,412,475 | A | * | 11/1968 | Zec | 34/428 |
| 3,413,683 | A | * | 12/1968 | Yelverton, Jr. | 425/131.5 |
| 3,434,222 | A | * | 3/1969 | Malmquist | 34/402 |
| 3,444,627 | A | * | 5/1969 | Heikinheimo | 34/448 |
| 3,448,530 | A | * | 6/1969 | Mortensen | 34/380 |
| 3,465,690 | A | * | 9/1969 | Landry et al. | 104/162 |
| 3,491,989 | A | * | 1/1970 | Fritz et al. | 432/230 |
| 3,509,637 | A | * | 5/1970 | Collier | 34/443 |
| 3,521,373 | A | * | 7/1970 | Pagnozzi | 34/406 |
| 3,524,303 | A | * | 8/1970 | Stoddard | 55/283 |
| 3,557,263 | A | * | 1/1971 | Marra | 264/45.3 |
| 3,574,949 | A | * | 4/1971 | Farnsworth | 34/407 |
| 3,585,734 | A | * | 6/1971 | Barton et al. | 34/116 |
| 3,596,776 | A | * | 8/1971 | Melin | 414/788 |
| 3,645,008 | A | * | 2/1972 | Delsack | 34/81 |
| 3,669,464 | A | * | 6/1972 | Linzmeier | 280/47.34 |
| 3,680,219 | A | * | 8/1972 | Koch | 34/396 |
| 3,721,013 | A | * | 3/1973 | Miller | 34/265 |
| 3,739,490 | A | * | 6/1973 | Comstock | 34/659 |
| 3,744,147 | A | * | 7/1973 | Pless | 34/259 |
| 3,746,358 | A | * | 7/1973 | Swick et al. | 280/651 |
| 3,749,003 | A | * | 7/1973 | Wilkes et al. | 100/35 |
| 3,757,428 | A | * | 9/1973 | Runciman | 34/340 |
| 3,804,482 | A | * | 4/1974 | Smith | 312/236 |
| 3,805,561 | A | * | 4/1974 | Bullock | 68/5 C |
| 3,830,466 | A | * | 8/1974 | Rasmussen et al. | 254/1 |
| 3,860,128 | A | * | 1/1975 | Lunden | 414/789.5 |
| 3,875,685 | A | * | 4/1975 | Koch | 34/236 |
| 3,878,942 | A | * | 4/1975 | Hansen et al. | 206/454 |
| 3,902,253 | A | * | 9/1975 | Sabuzawa et al. | 34/256 |
| 3,904,044 | A | * | 9/1975 | Lunden | 414/789.5 |
| 3,913,239 | A | * | 10/1975 | Burgin | 34/102 |
| 3,968,886 | A | * | 7/1976 | Leon | 414/789.5 |
| 3,986,268 | A | * | 10/1976 | Koppelman | 34/257 |
| 4,002,250 | A | * | 1/1977 | Connon, Jr. | 414/791.2 |
| 4,009,789 | A | * | 3/1977 | Runyan et al. | 414/788 |
| 4,017,980 | A | * | 4/1977 | Kleinguenther | 34/396 |
| 4,021,931 | A | * | 5/1977 | Russ et al. | 34/640 |
| 4,047,710 | A | * | 9/1977 | Wilson | 269/42 |
| 4,058,906 | A | * | 11/1977 | Pagnozzi | 34/406 |
| 4,064,386 | A | * | 12/1977 | Numrich, Jr. | 219/68 |
| 4,075,953 | A | * | 2/1978 | Sowards | 110/245 |
| 4,082,532 | A | * | 4/1978 | Imhof | 71/8 |
| 4,085,783 | A | * | 4/1978 | Jones | 144/208.1 |
| 4,106,215 | A | * | 8/1978 | Rosen | 34/217 |
| 4,122,878 | A | * | 10/1978 | Kohn | 144/350 |
| 4,123,221 | A | * | 10/1978 | Danford | 432/152 |
| 4,127,946 | A | * | 12/1978 | Buchholz | 34/408 |
| 4,144,976 | A | * | 3/1979 | Rysti | 414/789.5 |
| 4,146,973 | A | * | 4/1979 | Steffensen et al. | 34/266 |
| 4,168,581 | A | * | 9/1979 | Thode | 34/233 |
| 4,176,466 | A | * | 12/1979 | Pagnozzi et al. | 34/233 |
| 4,176,467 | A | * | 12/1979 | Brookhyser | 34/236 |
| 4,188,730 | A | * | 2/1980 | Allen et al. | 34/380 |
| 4,188,733 | A | * | 2/1980 | Brookhyser | 34/236 |
| 4,188,878 | A | * | 2/1980 | Kuhnau | 100/212 |
| 4,189,851 | A | * | 2/1980 | Brookhyser | 34/236 |
| 4,192,079 | A | * | 3/1980 | Brookhyser et al. | 34/380 |
| 4,193,207 | A | * | 3/1980 | Allen et al. | 34/380 |
| 4,194,296 | A | * | 3/1980 | Pagnozzi et al. | 34/410 |
| 4,194,298 | A | * | 3/1980 | Hart | 34/94 |
| 4,198,763 | A | * | 4/1980 | Kurihara | 34/409 |
| 4,211,389 | A | * | 7/1980 | Frey et al. | 24/269 |
| 4,233,752 | A | * | 11/1980 | Kleinguenther | 34/331 |
| 4,261,110 | A | * | 4/1981 | Northway et al. | 34/396 |

4,268,332 A * 5/1981 Winders ..... 156/160
4,296,555 A * 10/1981 Preston ..... 34/256
4,301,202 A * 11/1981 Kohn ..... 428/50
4,308,667 A * 1/1982 Roos et al. ..... 34/484
4,324,519 A * 4/1982 Moore ..... 414/788
4,366,607 A * 1/1983 MacCuaig ..... 24/270
4,378,640 A * 4/1983 Buchholz ..... 34/632
4,379,692 A * 4/1983 Weber et al. ..... 432/18
4,406,676 A * 9/1983 Potter ..... 95/275
4,415,444 A * 11/1983 Guptail ..... 209/3
4,427,480 A * 1/1984 Kamuro et al. ..... 156/287
4,445,025 A * 4/1984 Metz ..... 219/530
4,454,950 A * 6/1984 Stefanelli ..... 211/60.1
4,460,028 A * 7/1984 Henry ..... 144/366
4,466,198 A * 8/1984 Doll ..... 34/257
4,467,532 A * 8/1984 Drake ..... 34/407
4,472,618 A * 9/1984 Cloer ..... 219/775
4,476,663 A * 10/1984 Bikales ..... 52/847
D277,058 S * 1/1985 Tortensson ..... D6/468
4,500,001 A * 2/1985 Daniels ..... 206/597
4,505,465 A * 3/1985 McCrary ..... 269/130
4,558,525 A * 12/1985 Duske et al. ..... 34/128
4,620,373 A * 11/1986 Laskowski et al. ..... 34/406
4,637,145 A * 1/1987 Sugisawa et al. ..... 34/263
4,663,860 A * 5/1987 Beall ..... 34/396
4,681,146 A * 7/1987 Liska et al. ..... 144/369
4,686,121 A * 8/1987 Rogalla ..... 427/378
4,734,995 A * 4/1988 Pagnozzi et al. ..... 34/406
4,746,404 A * 5/1988 Laakso ..... 162/232
4,756,351 A * 7/1988 Knutsen ..... 144/379
4,757,979 A * 7/1988 Essex ..... 267/71
4,777,138 A * 10/1988 Levasseur ..... 435/290.2
4,785,554 A * 11/1988 Hederer et al. ..... 34/164
4,827,630 A * 5/1989 Honda et al. ..... 34/146
4,865,094 A * 9/1989 Stroud et al. ..... 144/176
4,875,592 A * 10/1989 Waller ..... 211/85.24
4,945,656 A * 8/1990 Judd ..... 34/585
4,955,146 A * 9/1990 Bollinger ..... 34/191
4,970,806 A * 11/1990 Hederer et al. ..... 34/164
4,993,171 A * 2/1991 Renzi ..... 34/92
5,066,229 A * 11/1991 Kitajima ..... 432/160
5,094,012 A * 3/1992 Rosenstock et al. ..... 34/468
5,103,575 A * 4/1992 Yokoo et al. ..... 34/255
5,169,498 A * 12/1992 Weston et al. ..... 162/246
5,228,209 A * 7/1993 Brunner ..... 34/417
5,230,163 A * 7/1993 Lease ..... 34/588
5,240,236 A * 8/1993 Mierau ..... 269/131
5,243,901 A * 9/1993 Green ..... 100/7
5,305,533 A * 4/1994 Alexander et al. ..... 34/549
5,307,897 A * 5/1994 Turner et al. ..... 182/3
5,325,604 A * 7/1994 Little ..... 34/493
5,357,881 A * 10/1994 Elcik et al. ..... 110/346
D354,664 S * 1/1995 Harrison ..... D8/51
5,394,667 A * 3/1995 Nystrom ..... 52/480
5,401,471 A * 3/1995 Scheler et al. ..... 422/143
5,414,944 A * 5/1995 Culp et al. ..... 34/218
5,416,985 A * 5/1995 Culp ..... 34/487
5,425,182 A * 6/1995 Brunner ..... 34/66
5,437,109 A * 8/1995 Culp ..... 34/231
5,447,686 A * 9/1995 Seidner ..... 422/26
5,454,176 A * 10/1995 Gobel et al. ..... 34/135
5,488,785 A * 2/1996 Culp ..... 34/307
5,526,583 A * 6/1996 Hull et al. ..... 34/491
5,533,717 A * 7/1996 Del Raso ..... 269/42
5,538,376 A * 7/1996 Borda ..... 410/99
5,547,546 A * 8/1996 Prough et al. ..... 162/238
5,566,515 A * 10/1996 Curry ..... 52/79.12
5,578,274 A * 11/1996 Seidner ..... 422/111
5,600,897 A * 2/1997 Sollinger et al. ..... 34/115
5,704,134 A * 1/1998 Carter et al. ..... 34/396
5,819,436 A * 10/1998 Helevirta ..... 34/408
5,826,379 A * 10/1998 Curry ..... 52/79.1
5,836,086 A * 11/1998 Elder ..... 34/396
5,846,620 A * 12/1998 Compton ..... 428/35.7
5,918,869 A * 7/1999 Christeson ..... 269/277
5,934,659 A * 8/1999 Johnson ..... 269/237
5,940,984 A * 8/1999 Moren ..... 34/396
5,954,157 A * 9/1999 Grimes et al. ..... 182/163
5,955,023 A * 9/1999 Ioffe et al. ..... 264/463
5,970,624 A * 10/1999 Moriya ..... 34/411
5,992,043 A * 11/1999 Guyonnet ..... 34/382
5,993,145 A * 11/1999 Lunden ..... 414/789.5
6,044,544 A * 4/2000 Christeson ..... 29/559
6,051,096 A * 4/2000 Nagle et al. ..... 156/311
6,061,923 A * 5/2000 Case ..... 34/90
6,080,978 A * 6/2000 Blaker et al. ..... 219/775
6,112,426 A * 9/2000 Buttazzi ..... 34/62
6,119,364 A * 9/2000 Elder ..... 34/212
6,124,028 A * 9/2000 Nagle et al. ..... 428/308.8
6,124,584 A * 9/2000 Blaker et al. ..... 219/779
6,138,379 A * 10/2000 DeVore et al. ..... 34/395
6,141,888 A * 11/2000 Cammarata ..... 34/536
6,154,980 A * 12/2000 Maguire ..... 34/370
6,164,588 A * 12/2000 Jacobsen ..... 242/610.4
6,180,002 B1 * 1/2001 Higgins ..... 210/185
6,219,937 B1 * 4/2001 Culp et al. ..... 34/396
6,225,612 B1 * 5/2001 Enegren ..... 219/780
6,243,970 B1 * 6/2001 Culp et al. ..... 34/508
6,293,152 B1 * 9/2001 Stanish et al. ..... 73/597
6,305,224 B1 * 10/2001 Stanish et al. ..... 73/597
6,308,786 B1 * 10/2001 Bestgen ..... 173/168
6,317,997 B1 * 11/2001 Kooznetsoff et al. ..... 34/92
6,327,792 B1 * 12/2001 Hebert ..... 34/104
6,345,450 B1 * 2/2002 Elder ..... 34/396
6,361,276 B1 * 3/2002 Beachum et al. ..... 416/61
6,393,723 B1 * 5/2002 Nagel ..... 34/201
6,397,488 B1 * 6/2002 Brinkly ..... 34/92
6,423,955 B1 * 7/2002 Blaker et al. ..... 219/775
6,460,583 B1 * 10/2002 Lindal ..... 144/347
6,467,190 B2 * 10/2002 Nagel et al. ..... 34/218
6,473,994 B1 * 11/2002 Dedieu et al. ..... 34/396
6,584,699 B2 * 7/2003 Ronning et al. ..... 34/134
6,598,477 B2 * 7/2003 Floyd ..... 73/597
6,605,245 B1 * 8/2003 Dubelsten et al. ..... 264/446
6,612,067 B2 * 9/2003 Topp ..... 43/124
6,634,118 B2 * 10/2003 Chen et al. ..... 34/412
6,652,274 B2 * 11/2003 Nagel et al. ..... 432/247
6,670,039 B1 * 12/2003 Nagle et al. ..... 428/408
6,675,495 B2 * 1/2004 Dedieu et al. ..... 34/245
6,676,214 B2 * 1/2004 McMillen et al. ..... 297/284.1
6,722,844 B2 * 4/2004 Lunden ..... 414/789.5
6,751,887 B2 * 6/2004 Hanhi ..... 34/250
6,784,672 B2 * 8/2004 Steele et al. ..... 324/663
6,818,102 B1 * 11/2004 Viol ..... 204/164
6,821,614 B1 * 11/2004 Dubelsten et al. ..... 428/298.1
6,857,201 B2 * 2/2005 Hottinen et al. ..... 34/398
6,893,089 B2 * 5/2005 McMillen et al. ..... 297/284.4
6,932,430 B2 * 8/2005 Bedford et al. ..... 297/300.2
7,043,853 B2 * 5/2006 Roberts et al. ..... 34/73
7,094,274 B2 * 8/2006 Aradi et al. ..... 95/58
7,219,951 B2 * 5/2007 Rasmussen ..... 296/156
7,234,247 B2 * 6/2007 Maguire ..... 34/92
RE40,156 E * 3/2008 Sharps et al. ..... 606/32
7,337,554 B2 * 3/2008 Erickson ..... 34/396
7,347,007 B2 * 3/2008 Maguire ..... 34/493
7,413,698 B2 * 8/2008 Bearse et al. ..... 264/511
7,458,809 B2 * 12/2008 Hohenshelt et al. ..... 432/120
7,589,145 B2 * 9/2009 Brant et al. ..... 524/515
7,837,923 B2 * 11/2010 Bearse et al. ..... 264/321
7,906,176 B2 * 3/2011 Balthes et al. ..... 427/294
2002/0108507 A1 * 8/2002 May et al. ..... 100/45
2003/0001595 A1 * 1/2003 Steele et al. ..... 324/717
2003/0079544 A1 * 5/2003 Floyd ..... 73/597
2003/0082043 A1 * 5/2003 Lunden ..... 414/789.5
2003/0094841 A1 * 5/2003 McMillen et al. ..... 297/284.1
2003/0150189 A1 * 8/2003 Ou et al. ..... 52/784.1
2003/0162461 A1 * 8/2003 Balthes ..... 442/411
2003/0170093 A1 * 9/2003 Janeway ..... 411/548
2004/0113472 A1 * 6/2004 McMillen et al. ..... 297/284.4
2004/0245827 A1 * 12/2004 Bedford et al. ..... 297/300.1
2005/0080520 A1 * 4/2005 Kline et al. ..... 701/1
2005/0140058 A1 * 6/2005 Dubelsten et al. ..... 264/319
2005/0170141 A1 * 8/2005 Bacon et al. ..... 428/141
2005/0223590 A1 * 10/2005 Erickson ..... 34/518
2005/0241787 A1 * 11/2005 Murray et al. ..... 162/113
2005/0263044 A1 * 12/2005 Bearse et al. ..... 108/57.25
2005/0266200 A1 * 12/2005 Padmanabhan ..... 428/54
2006/0020067 A1 * 1/2006 Brant et al. ..... 524/236

| | | | | |
|---|---|---|---|---|
| 2006/0093745 | A1* | 5/2006 | Nicholson et al. | 427/393 |
| 2006/0111003 | A1* | 5/2006 | Balthes | 442/327 |
| 2006/0178064 | A1* | 8/2006 | Balthes et al. | 442/59 |
| 2006/0219096 | A1* | 10/2006 | Aradi et al. | 95/58 |
| 2006/0254208 | A1* | 11/2006 | Clark et al. | 52/794.1 |
| 2006/0278254 | A1* | 12/2006 | Jackson | 134/21 |
| 2007/0116991 | A1* | 5/2007 | Balthes et al. | 428/920 |
| 2007/0141318 | A1* | 6/2007 | Balthes | 428/293.4 |
| 2007/0158134 | A1* | 7/2007 | Fryette | 181/199 |
| 2007/0207186 | A1* | 9/2007 | Scanlon et al. | 424/424 |
| 2008/0018026 | A1* | 1/2008 | Gregg et al. | 264/519 |
| 2008/0090477 | A1* | 4/2008 | Balthes et al. | 442/136 |
| 2008/0161972 | A1* | 7/2008 | Magill | 700/275 |
| 2008/0195119 | A1* | 8/2008 | Ferree | 606/139 |
| 2008/0230313 | A1* | 9/2008 | Botti | 182/70 |
| 2008/0264520 | A1* | 10/2008 | Abe et al. | 144/256.1 |
| 2008/0265460 | A1* | 10/2008 | Bearse et al. | 264/255 |
| 2008/0272511 | A1* | 11/2008 | Bearse et al. | 264/135 |
| 2009/0206223 | A1* | 8/2009 | Aaron | 248/346.02 |
| 2010/0030224 | A1* | 2/2010 | Winslow et al. | 606/104 |
| 2010/0030267 | A1* | 2/2010 | Winslow et al. | 606/246 |
| 2010/0030270 | A1* | 2/2010 | Winslow et al. | 606/254 |
| 2010/0030272 | A1* | 2/2010 | Winslow et al. | 606/260 |
| 2010/0030274 | A1* | 2/2010 | Mitchell et al. | 606/264 |
| 2010/0030275 | A1* | 2/2010 | Winslow et al. | 606/264 |
| 2010/0036421 | A1* | 2/2010 | Winslow et al. | 606/254 |
| 2010/0036427 | A1* | 2/2010 | Winslow et al. | 606/264 |
| 2010/0036435 | A1* | 2/2010 | Winslow et al. | 606/305 |
| 2010/0036436 | A1* | 2/2010 | Winslow et al. | 606/305 |
| 2010/0036437 | A1* | 2/2010 | Mitchell et al. | 606/305 |
| 2010/0036438 | A1* | 2/2010 | Mitchell et al. | 606/305 |
| 2010/0075095 | A1* | 3/2010 | Johnson et al. | 428/53 |
| 2010/0119857 | A1* | 5/2010 | Johnson et al. | 428/537.1 |
| 2010/0145388 | A1* | 6/2010 | Winslow et al. | 606/264 |
| 2010/0154333 | A1* | 6/2010 | Peek et al. | 52/232 |
| 2010/0168795 | A1* | 7/2010 | Winslow et al. | 606/264 |
| 2010/0199891 | A1* | 8/2010 | Miller et al. | 108/57.17 |

FOREIGN PATENT DOCUMENTS

| | | | | |
|---|---|---|---|---|
| DE | 3712775 | A1 | * | 11/1988 |
| EP | 58369 | A2 | * | 8/1982 |
| EP | 80456 | A2 | * | 6/1983 |
| EP | 130309 | A1 | * | 1/1985 |
| EP | 750084 | A1 | * | 12/1996 |
| EP | 931635 | A1 | * | 7/1999 |
| EP | 1039093 | A2 | * | 9/2000 |
| FR | 2586613 | A1 | * | 3/1987 |
| FR | 2602171 | A1 | * | 2/1988 |
| GB | 2124911 | A | * | 2/1984 |
| GB | 2141155 | A | * | 12/1984 |
| GB | 2217360 | A | * | 10/1989 |
| GB | 2245880 | A | * | 1/1992 |
| GB | 2403958 | A | * | 1/2005 |
| GB | 2405126 | A | * | 2/2005 |
| GB | 2438521 | A | * | 11/2007 |
| JP | 01047503 | A | * | 2/1989 |
| JP | 08117124 | A | * | 5/1996 |
| JP | 08254039 | A | * | 10/1996 |
| JP | 10280841 | A | * | 10/1998 |
| JP | 11059231 | A | * | 3/1999 |
| JP | 11140852 | A | * | 5/1999 |
| JP | 11208349 | A | * | 8/1999 |
| JP | 11310959 | A | * | 11/1999 |
| JP | 2001132107 | A | * | 5/2001 |
| JP | 2001262717 | A | * | 9/2001 |
| JP | 2003074021 | A | * | 3/2003 |
| JP | 2005282324 | A | * | 10/2005 |
| JP | 2007086609 | A | * | 4/2007 |
| JP | 2009174153 | A | * | 8/2009 |
| JP | 2009184052 | A | * | 8/2009 |
| JP | 2010173284 | A | * | 8/2010 |
| WO | WO 9202763 | A1 | * | 2/1992 |
| WO | WO 2005054111 | A1 | * | 6/2005 |

OTHER PUBLICATIONS

"Permanence of warp reduction in press-dried plantation loblolly pine 2 by 4's", W. Simpson, *Forest Products Journal*, vol. 40(11/12), Nov./Dec. 1990, p. 51-52.

"Effect of conditioning and mechanical deflection on the warp of kiln-dried southern pine studs", F. Taylor et al., *Forest Products Journal*, vol. 40(1), Jan. 1990, p. 42-44.

"Twist Reduction of Pinus Patula Schlecht. Et Cham. Lumber by Mechanical Restraint During Kiln Drying", K. Tischler et al., Leaflet 67, 1979, p. 1-11.

"Reducing Crook in Kiln-Dried Northern Aspen Studs", J.F.G. Mackay et al., *Forest Products Journal*, vol. 27(3), 1977, p. 33-38.

"Press-drying plantation loblolly pine lumber to reduce warp losses: economic sensitivity analysis", W. Simpson, *Forest Products Journal*, vol. 42(6), Jun. 1992, p. 23-23.

Press-drying plantation-grown loblolly pine 2 by 4's to reduce warp, W. Simpson et al., *Forest Products Journal*, vol. 38(11/12), Nov./Dec. 1988, p. 41-48.

"Warp Reduction in Young-Growth Ponderosa Pine Studs Dried by Different Methods With Top-Load Restraint", D. Arganbright et al., *Forest Products Journal*, vol.28 (8), Aug. 1978, p. 47-52.

"Serrated Kiln Sticks and Top Load Substantially Reduce Warp in Southern Pine Studs Dried at 240° F.", P. Koch, *Forest Products Journal*, vol. 24(11), 1974, p. 30-34.

* cited by examiner

RESTRAINING DEVICE FOR REDUCING WARP IN LUMBER DURING DRYING

This application refers to and claims priority from U.S. Provisional Application Ser. No. 60/561,424, filed Apr. 12, 2004, the entire content of which is incorporated herein by reference.

BACKGROUND OF THE INVENTION

The present invention relates to a restraining and force applying device that is used during a drying process for lumber pieces to reduce warp, that is, reducing the amount of crook, twist, bow and cup, of the dried lumber pieces. The device applies horizontal force to clamp together the edge surfaces of the individual lumber pieces placed edge to edge in courses of lumber pieces, and maintains these clamping forces throughout the drying process and, if required, while the lumber cools. The horizontal force is parallel to the width face of the lumber, and thus to the plane of the course of lumber as opposed to vertical forces parallel to the narrower edge surfaces of lumber pieces and perpendicular to the plane of the lumber courses. A vertical force also can be applied during drying, if desired. The horizontal clamping force applied to the courses of stacked lumber pieces keeps the individual lumber pieces securely restrained and in tight edge to edge contact throughout the drying process. Under the forces applied, the lumber pieces are held straight so that the amount of warp (crook, twist, bow and cup) is significantly reduced or eliminated.

In the prior art, it has been known to vertically restrain stacks of lumber as the lumber is dried in a kiln, or by other means of drying, through the use of weights on the top of the stack, which provides a vertical downward force on the stack. The lumber is generally stacked in layers or courses with each course separated from the next overlying layer or course by spacers called "stickers". The stickers create passageways for air movement through the stack of lumber between the courses.

The vertical load now applied on a stack of dimension lumber, such as for two-by-four studs of eight-foot length, is an attempt to reduce the warp in the individual lumber pieces as the lumber is dried. However, the effectiveness of vertical loads has been less than satisfactory, with a great deal of crook and twist of the dimension lumber occurring both during drying and after release from the lumber stack. The application of dead weight on top of the lumber stacks during drying is usually in the form of concrete blocks or a panel of steel. Also, it has been known to apply loads using hydraulic rams, again, in a vertical direction.

The most serious and degrading forms of warp in dimension lumber are crook and twist. Crook is a deviation of the narrow edges of a piece of lumber from a straight line, while twist is the rise of a corner of the piece out of a horizontal plane from one end to the other. Grading rules for each size and grade of lumber mandate specified maximum amounts of crook and twist. Straighter lumber has the potential for meeting higher grades and thus increased value. Upgrading the lumber pieces to higher grades via warp reduction produces a substantial increase in both profitability of a mill and the assurance of better performance in subsequent use of the lumber.

Presently, any resistance to crook development in individual dimension lumber pieces, such as studs, relies upon the ability of top loading to increase the frictional resistance to movement between the lumber pieces in each of the courses of lumber and the stickers used to separate the courses. The effect on reducing crook with only vertical forces is marginal, particularly for those individual lumber pieces with lower than average thickness.

SUMMARY OF THE INVENTION

The present invention provides apparatus to maintain a lateral or horizontal force on a stack of lumber that keeps lumber pieces in unyielding edge to edge contact as the lumber is dried.

A restraint device is provided that corrects the problem of excessive warping, especially crook, of dimension lumber as the lumber is dried. Lumber pieces are placed side by side to create horizontal courses which are then loaded and held clamped edge to edge with a horizontal force, that is, a force parallel to the wide faces (width) of the lumber pieces. The force thus is perpendicular to the edge (narrow side) of each course and is sufficiently large to hold the pieces of lumber warp free as they are dried. Courses (horizontal layers) of individual lumber pieces are laid down, and the courses are separated vertically by stickers to provide a space for air flow between the courses. The space between courses has a plane and the clamping force is parallel to the plane of the air flow space and parallel to the lumber courses. The horizontal load is of a magnitude to provide a side or edge force resisting any crooking or slippage of the lumber pieces one upon another. The restraint system takes up or prevents the spaces between the edges of adjacent lumber pieces that occur in contemporary drying as a consequence of the unavoidable width shrinkage of individual lumber pieces.

Vertical forces from top loading are optional. Preventing crook on dimension lumber, for example two-by-fours, with the four inch or side dimension laid horizontally, for drying, and formed into courses with the edge surfaces (2 inch nominal) of adjacent lumber pieces in contact, requires restraining the boards from separating, as well as taking up the shrinkage by providing a substantial uniform, and continuous adequate level clamping force for edge loading as drying proceeds.

Various devices and designs can be utilized for providing an edge, generally horizontal load, which is defined as a load that acts substantially parallel to a wide side surface, or in other words, loads the courses with a force perpendicular to its narrowest dimension.

DETAILED DESCRIPTION OF THE PREFERRED EMBODIMENTS

Figure 1:
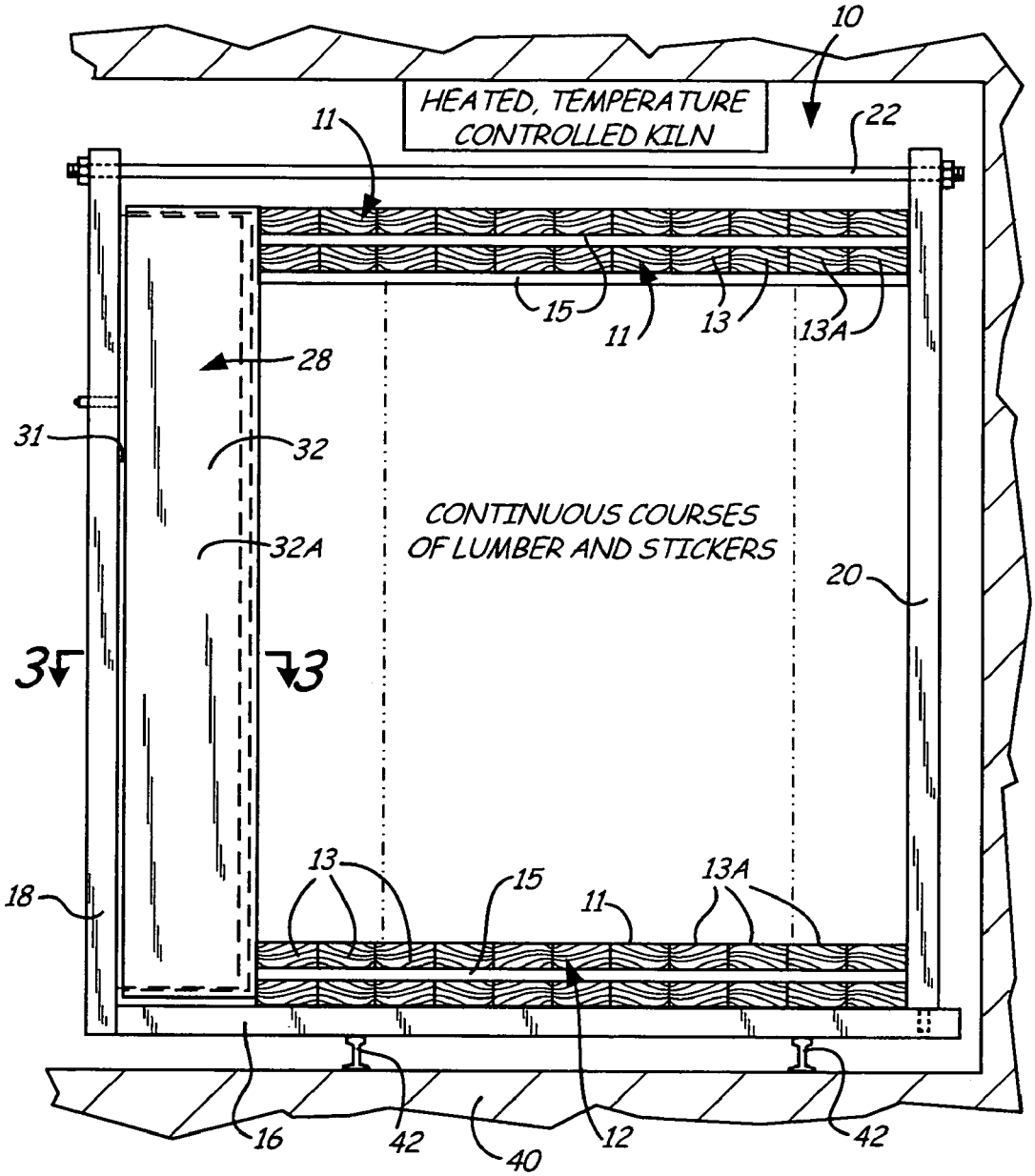
FIG. 1 is an end view of a four sided, openable frame for receiving a stack of lumber and applying a horizontal clamping force for preventing warp in accordance with the present invention.

The general concept of the present invention is set forth in FIG. 1, wherein a unit or stack of lumber 12 in a view is contained within a plurality of quadrangle (four sided) restraining frames or devices 10. Each quadrangle frame 10 is designed to employ a selected one of a variety of force applicators to provide continuous, edge wise pressure or force on the individual horizontal courses 11 (horizontal layers) of individual lumber pieces 13 that make up the stacked unit 12. The individual lumber pieces 13 of each course are laid edge to edge so that the wide face or width 13A is horizontal. The courses are separated by stickers or spaces 15 to form an air flow space of channel 15A between and parallel to the plane of the course of lumber pieces. The quadrangle frame 10 consists of vertical and horizontal steel components, including a horizontal base, comprising a base channel 16 that has an upright channel or member 18 fixed to one end to form a lumber unit support. The quadrangle frame 10 has a removable force reaction bar or channel 20 opposite the upright channel 18. The upper ends of channels 18 and 20 are joined with a top tie rod 22. The tie rod 22 can be secured in any suitable manner. As shown, the threaded nuts are used at the ends for securing it in place.

The junction between the base channel 16 and upright channel 18 can be a permanent connection such as welding, or a bolted or otherwise rigid or semi-rigid connection that affords the ability to disassemble.

Figure 4:
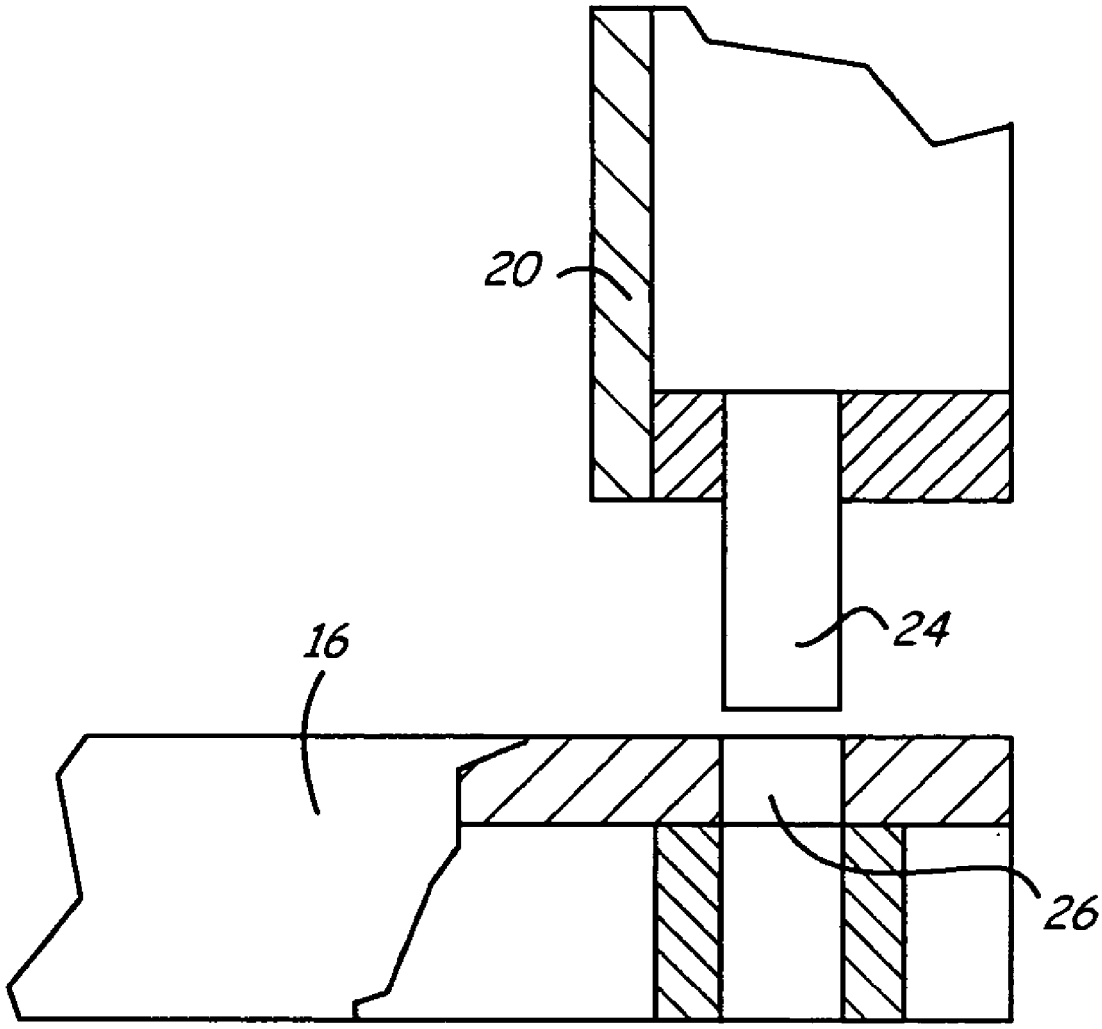
FIG. 4 is a fragmentary enlarged exploded view of a removable reaction bar coupling to a base member to the openable frame shown in FIGS. 1 and 2.

The force reaction bar or channel 20 is removable and has a body end projection or shaft 24 (FIG. 4) for insertion into a selected one of a sequence or series of openings 26 near the end of base channel 16 opposite the end supporting the upright channel 18. The top tie rod 22 is a tie rod or other form of steel tension member between the top ends of upright channel 18 and reaction bar 20. The members of the quadrangle frame are selected to be non-deformable during application of the horizontal clamping force generated by a pressure loading assembly 28 that is supported on and extends along the upright channel 18.

Figure 3:
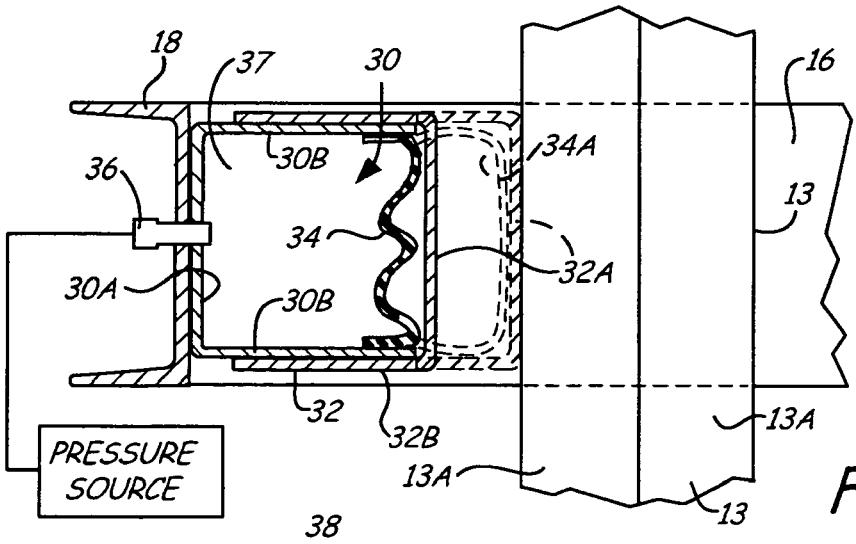
FIG. 3 is a sectional view of a load applying side of the frame of FIG. 1 taken on line 3-3 in FIG. 1.

The loading assembly 28 comprises a pressure expandable, full vertical height, two section chamber. A base chamber 30 (FIG. 3) has a base wall 30A and side walls 30B that are closed with end walls at the top and bottom of the chamber. It thus forms an open sided box. The base chamber 30 extends to the desired height of the unit 12 of the courses 11 of lumber pieces 13. The upright channel or bar 18 extends upwardly beyond the base chamber 30 so that the cross tie rod 22 can be installed.

The pressure loading assembly 28 includes a telescoping outer chamber 32 that has an outer wall 32A that extends vertically, and a pair of side walls 32B that slide along the outside of the walls 30B of the base chamber 30, and the outer chamber 32 also has top and bottom walls to form an open sided box that slips over the base chamber 30.

A flexible membrane 34 closes the open side of the base chamber 30 and is sealed airtight to the side walls and the top and bottom walls of the base chamber to form a pressure tight internal chamber 37. A pressure fitting 36 is provided in the base wall 30A, and through the upright channel 18 and connected to a suitable, preferably controlled, fluid pressure source 38. When fluid under pressure is provided to chamber 37, the flexible sealing member 34 expands out pushing the outer chamber 32 against the lumber unit 12 of courses 11 of lumber pieces 13 with a horizontal force that is parallel to the wide face or width of the pieces of lumber and parallel to the plane of the lumber courses. Thus, the pressure loading assembly comprises a gaseous fluid actuator.

Figure 2:
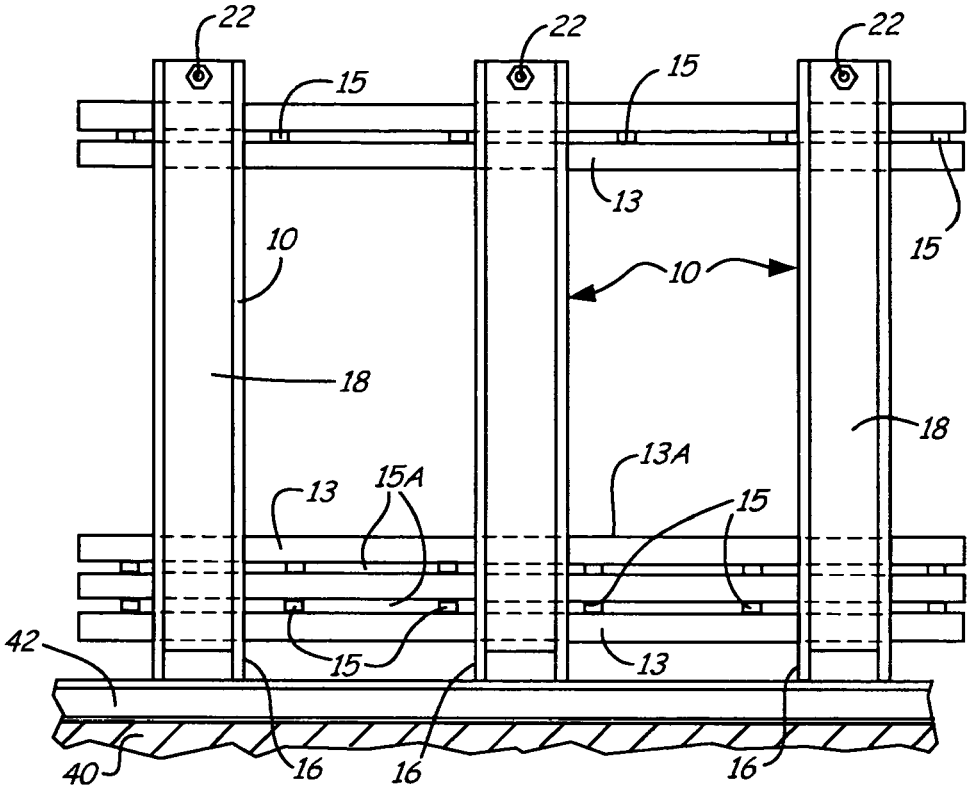
FIG. 2 is an illustrative side view of the first form of the present invention and illustrating placement of the four sided, openable frames of FIG. 1.

The quadrangle frame 10 as illustrated is one of a chosen or of a selected number of frames spaced along the length of the unit of lumber. For example, if the unit 12 consists of 100 inch long by 2 inch by 4 inch studs, a recommended number of quadrangle frames 10 is three, as shown in FIG. 2, one near each end of the unit and one at mid-length. The quadrangle frames 10 can be fully assembled piece by piece around a pre-existing unit of stickered lumber, if desired, or when base channel 16 and upright channel 18 are an L-shaped subframe, with the tie rod 22 and reaction bar 20 removed, stickered units of lumber can be set in place on the base channel 16. A forklift can be used to put the lumber unit in place. The vertical reaction bar 20 and tie rod 22 are then installed to complete the quadrangle frame assembly 10. A third alternative is by placing a layer of lumber pieces on the channel bases 16 of the three frames with the vertical bars in place, and then putting stickers 15 on the first course and building the courses 11 piece by piece. Repetitive placement of complete courses of lumber can also be done with a mechanical stacker, and stickers 15 placed between the courses as the unit is formed, as currently done in many commercial operations.

Prior to the application of clamping force edgewise to each course of lumber pieces, the individual pieces in each course can be in modest edge to edge contact. The initial application of force will remove any possible length wise deviations of the narrow edges from a straight line, i.e., remove any pre-existing crook traceable back to growth stresses present in the tree. This converts each course during the drying process to an integrated slab similar to a flitch, forced to give up its moisture through the horizontal wide surfaces or width of each lumber piece into the air travel space provided by the stickers. The continuous edgewise clamping force from the loading assembly 28 on the upright bar 18 eliminates the opportunity for shrinkage-caused openings to develop between the individual lumber pieces, as in contemporary conventional drying. The edge to edge contact of the lumber pieces, accomplished under adequate force, also prevents any possible inherent differences in longitudinal shrinkage for the two narrow edges of each of the lumber pieces being translated into crook. With the lumber pieces held straight during drying, especially in the context of high temperature kiln drying that plasticizes the wood and promotes stress relief, the lumber pieces remain straight when the clamping force is removed at the end of drying.

Since the percent shrinkage values for commercial woods as a function of average moisture content are well known, the desired end point of drying is readily determinable by measuring the overall shrinkage of one or more courses 11 contained in the unit of restrained lumber by direct ruler type measurement or an automated device that registers readings at a remote location.

The magnitude of the continuous force applied to the unit of lumber during its drying depends on the initial air pressure in the chamber 37 and the changes in volume, pressure and temperature that the air undergoes during the overall drying process. The basic air pressure chamber 37 consists of the two enclosed telescoping members analogous to the two box sections employed for containing a two-pound block of brick formed cheese. The movable "box" 32 of the two sections that make up the pressure loading assembly 28 illustrated in FIGS. 1 and 3. The open face of the fixed chamber 30 is rendered air tight by a rubber (flexible) membrane or diaphragm section or base chamber securely sealed to the inside perimeter of the fixed box near its open face. The securement of a rubber membrane of the required physical properties to the walls of the fixed base chamber or box section, which is preferably fabricated of steel, results in a closed chamber 37 that is capable of withstanding different levels of air pressure. When the membrane 34 expands it provides a force to the movable chamber 32 and the base wall 32A bears against the individual courses of lumber that make up the unit of lumber and the clamping force is parallel to the planes of the individual courses.

Each pressure chamber 37 of the three quadrangle frames 10 can be pressurized at a different level from the others, or all chambers 37 can be connected to a common pressure source and carry the same pressure.

The kiln drying of softwood dimension lumber is generally accomplished with the dry bulb temperature of the kiln atmosphere increasing steadily over a period of time to eventually arrive at a desired steady-state temperature that is maintained to the end of the drying process. Since the air pressure force applying assembly 28 is constructed primarily of steel, the temperature of the air it contains will come to and remain in close equilibrium with the dry bulb temperature of the kiln atmosphere in which it resides. In this context, there occurs an expansion or compression of the gas that conforms to the General Gas Law. According to this law, "the pressure of any given quantity of gas is proportional to the absolute temperature and inversely proportional to the volume". In practical application of the law, the following equations are instructive:

$$\frac{P_1V_1}{T_1} = \frac{P_2V_2}{T_2} = \frac{P_3V_3}{T_3} \text{ etc.}$$

in which:

P=pressure; V=volume and T is absolute temperature, and the absolute temperature=T° C.+273=°Kelvin.

It is thus informative to illustrate performance of the General Gas Law in kiln drying a unit of green lumber to some final desired average moisture content. This illustration is in the context of defining the dimensions of the fixed box of 28 as having sidewall dimensions of 10 in. wide and 50 in. in height and the dimensions of its wall fixed to upright 18 being of 50 in. high and 3 in. wide.

With a lumber unit 12 in place and a given number of quadrangle frames 10 surrounding it, assume the chamber containing the rubber membrane is inflated to 20 psi at an ambient air temperature of 20° C. This forces the individual lumber pieces of the courses 11 tightly edge to edge and into uniformly straight pieces. As the temperature of the kiln atmosphere increases during continued operation, the temperature of the pressurized air maintains equilibrium with the dry bulb temperature of the kiln atmosphere. The steady increase in dry bulb temperature accompanied by a steady increase in the wet bulb depression produces an in-kiln air atmosphere conducive to rapid drying of the lumber. As the lumber pieces dry, the width of the lumber unit decreases due to shrinkage and in keeping the volume of the air contained in the diaphragm sided chamber 30 increases in accordance with the amount of lumber shrinkage.

At the initial 20° C. temperature and a pressure of 20 psi, the air chamber 37 volume is approximately 1500 cubic in., i.e., a chamber of 3×10×50 in. At a kiln air temperature of 50° C., the volume of 1500 cubic in. will increase to 1654 cubic in. if the initial air pressure of 20 psi remains constant.

In keeping with the General Gas Law, $$\frac{V_1P_1}{T_1} = \frac{V_2P_1}{T_2}$$

and thus:

$$V_2 = V_1\frac{T_2}{T_1},$$

in which $T_1$=20° C.+273=293° Kelvin $T_2$=50° C.+273=323° Kelvin from which $$V_2 = 1500 \text{ in}^3 \times \frac{323°}{293°} = 1654 \text{ in}^3$$

However, in order for the pressure to remain constant, the increase in air volume due to shrinkage of the lumber must equal 154 in. If we assume the width of the lumber unit has decreased by 1 inch, the air volume will have increased by approximately the amount of 154 cubic in. ($in^3$). This is shown as follows:

The original 1500 $in^3$+(3 in.×50 in.×1 in.)=1500 $in^3$+150 $in^3$=1650 $in^3$.

The increase in air volume thus depends upon the inherent shrinkage for the specific type and species of lumber and the fraction of that shrinkage being realized at the specific level of average MC of the lumber.

At a kiln air temperature of 50° C., it is likely that the absolute width shrinkage of an original 48 in. wide lumber unit is less than the 1.0 inch employed in the above calculation. Thus, the volume of the air is not increasing in accordance with a constant pressure and thereby the pressure at 50° C. is slightly higher than the central starting pressure of 20 psi. Further, in keeping with the well known relationships of wood shrinkage to average moisture content of the wood, it is probable that the air pressure in the chamber will remain slightly above its initial temperature during all or at least most of the kiln residence time of the restrained lumber. Maximum lumber shrinkage for the overall drying process is reached at the end of drying. Thus, it is of interest and need to evaluate the overall situation at the end point of the process. If the unit of lumber 12 illustrated in FIG. 1 is 48 in. wide and the final average moisture content of the lumber is near 10 percent, the average width shrinkage at that moisture content will perhaps be in the range of 4-5 percent. Using the 5 percent value, this equates to an absolute change in width for the lumber unit of 2.4 in., i.e., 48 in.×0.05=2.4 in. As a consequence, the volume of the air contained in the chamber has increased from its original 1500 $in^3$ to 1860 $in^3$. The increase of 360 $in^3$ is derived from multiplying the total horizontal movement of the outer chamber 32 times its approximate cross sectional area, i.e., (2.4 in.×3.0 in.×50 in.) equals 360 $in^3$. A common dry bulb air temperature in the kiln at the end of drying for nominal 2 in. thick softwood dimension lumber is 240° F., which equates to 116° C. The air volume in the chamber 37 near to and at the end of drying becomes nearly constant since the average moisture content of the lumber is near equilibrium with the drying potential of the kiln's atmosphere and thereby wood shrinkage is inactive. Thus, the following calculation can be performed:

$$\frac{P_1V_1}{T_1} = \frac{P_2V_2}{T_2} \text{ and } \frac{(20\text{ psi})(1500\text{ in}^3)}{293} = \frac{(P_2)(1860\text{ in}^3)}{389}$$

from which $$P_2 = \frac{389}{293} \times \frac{30000(\text{psi})(\text{in}^3)}{1860\text{ in}^3} = 1.328 \times 16.129 = 21.4\text{ psi}$$

Therefore, with a 48 in. width unit of lumber, a width shrinkage for the lumber unit of 5 percent, an assumed final average moisture content of 10 percent and the dimension of the pressurized air chamber as employed, the final air chamber pressure is nearly 1.5 psi greater than the initial pressure.

For units 12 of lumber wider than 4 feet, and especially in the context of high shrinkage values for the wood, the initial volume of pressurized air can be increased to accommodate its magnified increase in volume and thereby maintain at least constant or preferably somewhat increasing force on the lumber unit 12 throughout the drying process. For example, the volume of the air chamber 37 in FIGS. 1 and 2 could be doubled to accommodate an 8-foot unit width of the same lumber to produce the same outcomes as those calculated for the 4 foot wide lumber unit.

The required volumes of pressurized air are perhaps best obtained by employing a pressurized steel storage tank connected to the fixed chamber by appropriate hose connections and valves. The added pressurized storage capability should be designed and situated in the most efficient manner possible with respect to the unit of lumber under restraint.

A sequence of the right angle (L-shaped) subframes created by the joining of base channel 16 and upright channel 18, as shown in FIG. 1 can be fixed to a pair of supporting rails 42 running parallel to the length of the lumber unit. Spacing of the L-shaped assemblies is in keeping with the length of the lumber unit and the propensity of warp for the species being dried. As an example, for southern yellow pine nominal 2 in. by 4 in. lumber 100 in. long, three of the L-shaped frames would be affixed to a parallel pair of properly spaced 8 foot long steel rails, with one L-shaped frame near each end of the rails and the third at mid-length of the rails. With a lumber unit in place on the sequence of horizontal steel base channels 16, the perimeter of the quadrangle frames or restraining device is completed by installation of members 20 and 22. The entire assembly of restraint quadrangle frames, steel rails and units of lumber then becomes a portable assembly to be handled by a forklift or other means into a conventional heated kiln shown schematically at 40. These individual assemblies of lumber unit and quadrangle frames can then be placed on kiln cars for transport into the drying kiln or elsewhere by the same means currently used for separate units of stickered lumber. Since the individual pieces of lumber and the stickers 15 are held firm during subsequent transport and overall handling, the opportunity for unfavorable misalignment of stickers 15 and lumber pieces 13, or actual fallout of each from the unit, is avoided. These portable assemblies can also be placed one upon another in the same format currently employed for separate unrestrained units of stickered lumber.

Within the kiln atmosphere one or more steel storage tanks for providing additional air volume under pressure could be used to supplement the air volume capability inherent to the pressure creating assemblies 28 incorporated into each restraint quadrangle frame 10. The master storage pressure source tank or tanks would be connected to each of the individual air pressure chambers via an optimized line design and any required valving.

The pressure loading assembly 28 of FIG. 1 is replaceable by any one of several alternative force generators such as air bags, air pressure springs or cylinders; steel springs, liquid hydraulic systems or leverage systems driven by gravity, etc. Each is employable and able in its individual design to provide continuous edge to edge clamping pressure onto the courses of lumber that make up a given lumber unit. These alternative force generators would likely not deliver force to the lumber by using the movable box form that is part of the pressure loading assembly 28. Instead, a vertical pressure bar, driven by one of the alternative types of force generators, would deliver a force perpendicular to the planes of vertically orientated edges of the lumber courses.

For example, an air cylinder or cylinders driven by an offsite air compressor, which is positioned between the vertically orientated channel 18 and a pressure bar resting on the full height of the vertical side face of the lumber unit. Again, a scissors-type of leveraged system, driven by gravity acting on a dead weight load or by an alternative force generator is also a candidate for impelling the above defined pressure bar.

Figure 5:
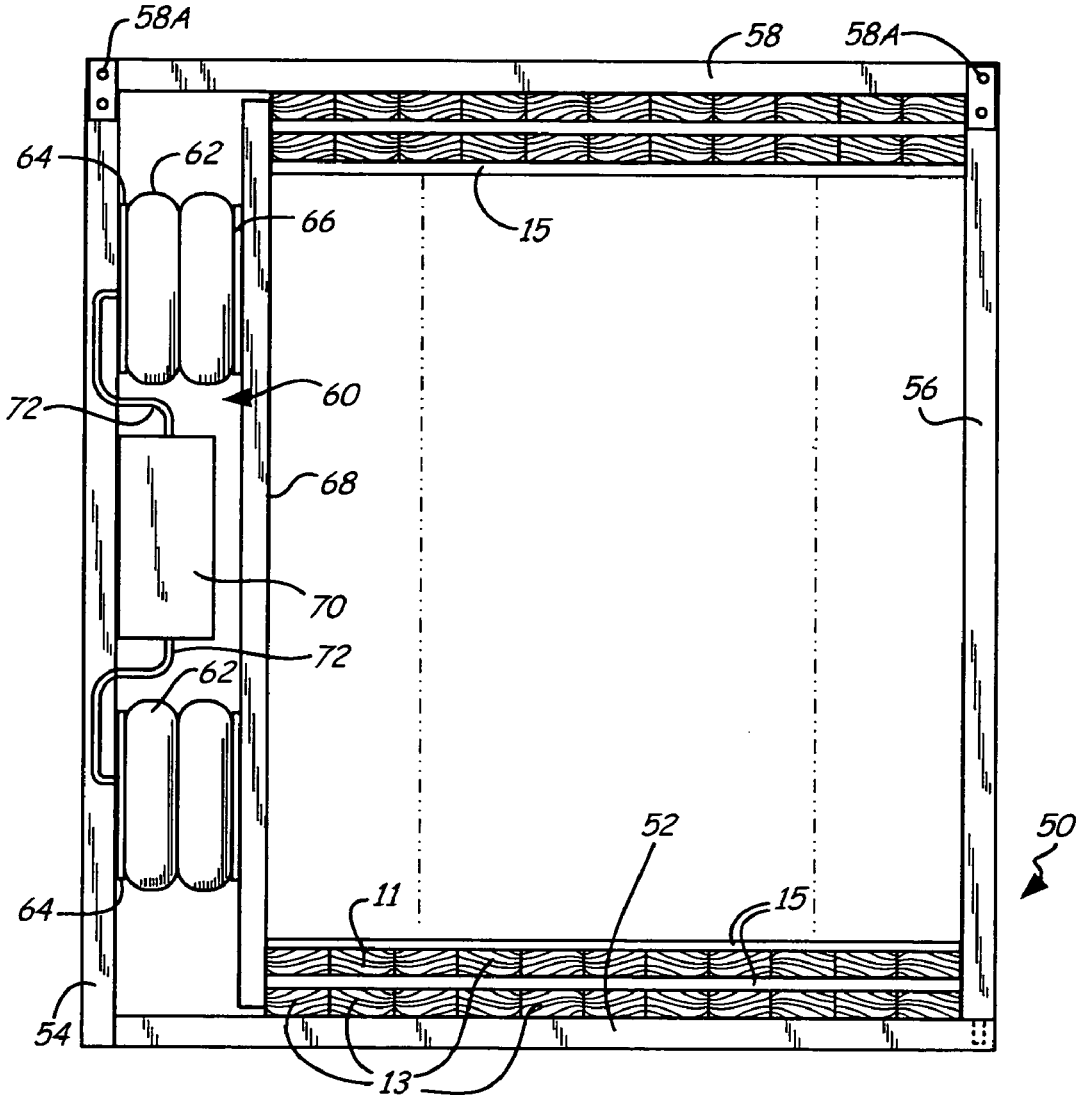
FIG. 5 is a schematic view of an alternative force generating device capable of use in openable frames similar to those shown in FIG. 1.

In FIG. 5, a modified quadrangle frame and pressure creating assembly is illustrated. The quadrangle frame 50 includes a base member or channel 52, that can be essentially the same as that indicated before, with an upright channel or member that can be called a first reaction bar indicated at 54 rigidly attached to one end of the base member 52 and extending upwardly. A second or outer reaction bar 56 can be removably secured to the opposite end of the base channel 52, as in the previous form of the invention, and the upper ends of the first reaction bar or upright member 54 and the second reaction bar or upright member 56, which is removable, are tied together with a tie bar 58.

The individual courses 11 of lumber pieces 13 are numbered the same, and can be supported on the bottom or base member 52 in the normal manner and separated with stickers 15. In this form of the invention, the pressure loading assemblies are indicated generally at 60, and include a pair (more can be used) of conventional pneumatic air springs 62, each of which is a fluid spring or actuator that is fixed at one end as at 64 to the upright member or first reaction bar 54, and the expandable or outer end of the airbags 62 are affixed as at 66 to a push bar 68 that is spaced from and positioned between the base channel 52 and the tie bar 58, but of sufficient length to engage all of the courses 11 of the lumber pieces 13. A fluid pressure source or tank 70 can be provided on and secured on the first reaction bar, and connected with suitable hoses 72 to the respective air spring 62. As shown, these are double chamber air springs, but other suitable fluid pressure cylinders could be substituted.

The action in this form of the invention is the same as previously explained, wherein the unit of lumber pieces having the stickers 15 between them can be stacked onto the subframe when the second reaction bar 56 has been removed, and then the second reaction bar 56 can be put into place and fastened with a tie bar, through suitable fasteners that are shown generally at 58A as bolts, and suitable fastening straps, so that the frame and lumber units are complete. The entire assembly can then be placed into a kiln with a forklift. Suitable spacers can be provided below the cross member 52 so that the forklift forks can be placed under the base channel or member 52.

It can be seen here that the use of the continuous pressure springs can be accomplished easily by using airbags and a movable push bar that provides a horizontal force that is parallel to the wide faces of lumber pieces for preventing crook and other distortions of the individual number of pieces.

Figure 6:
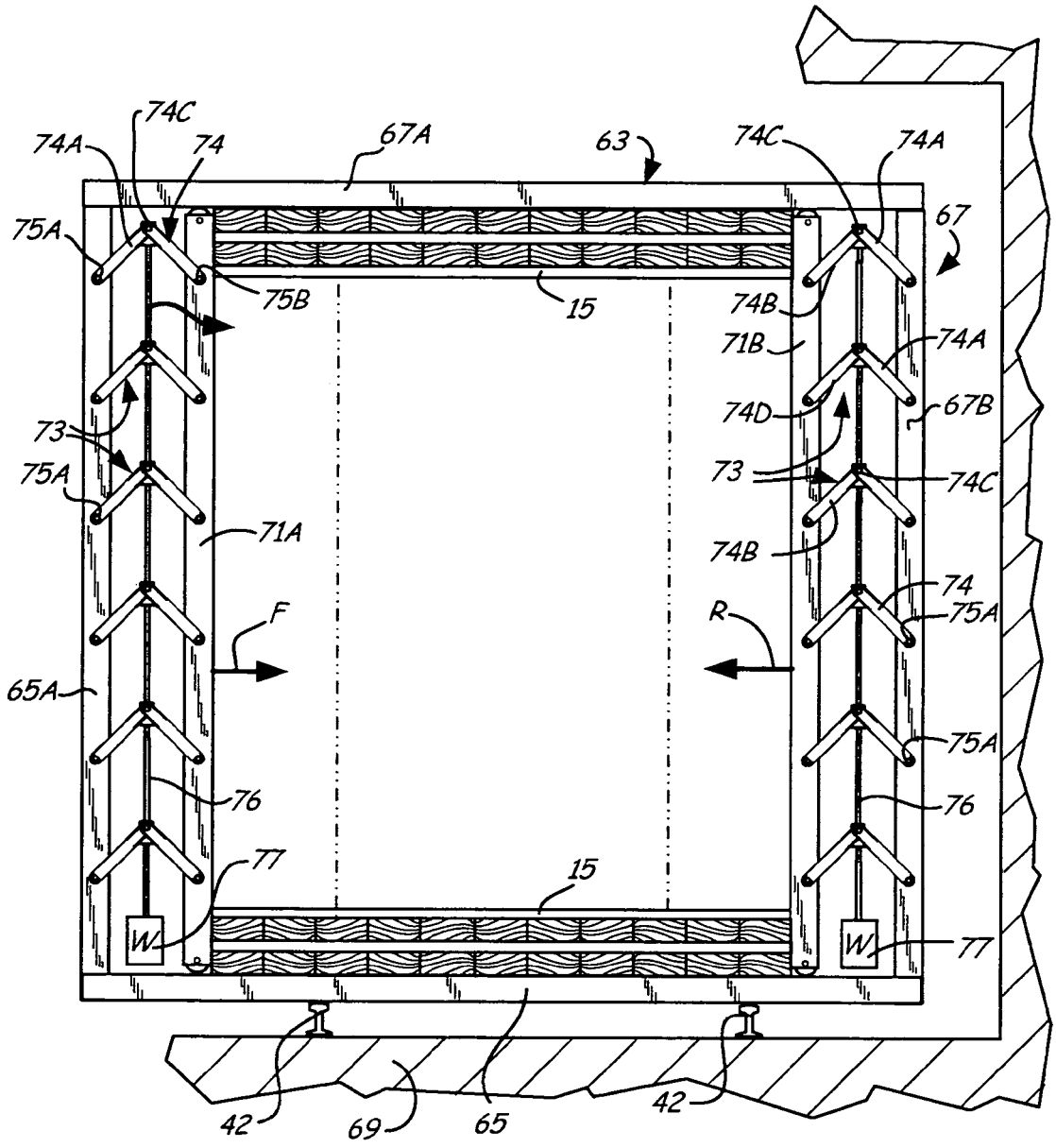
FIG. 6 is a modified form of a load applying linkage arrangement for applying horizontal clamping force to a stack of lumber in a kiln.
Figure 7:
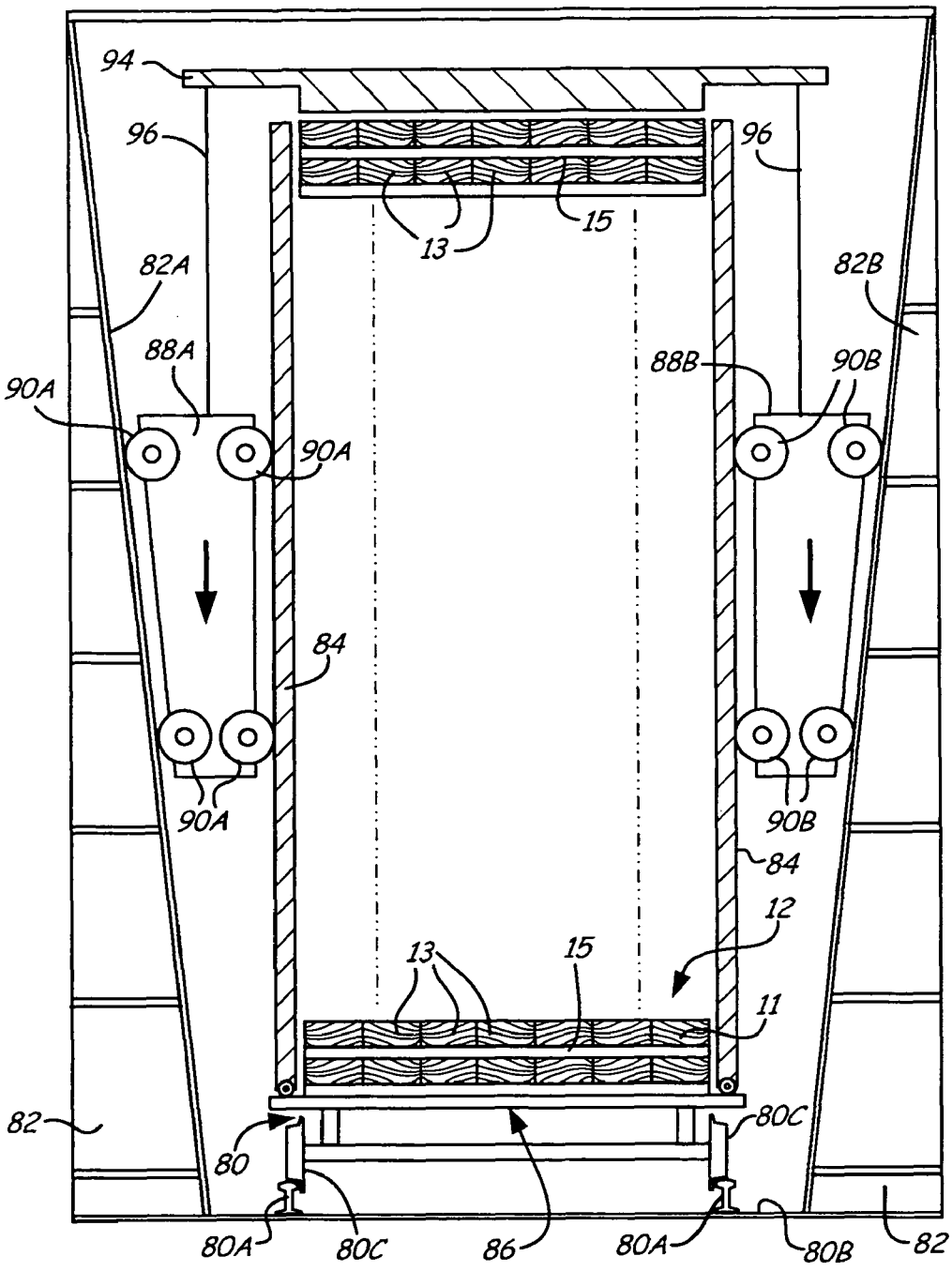
FIG. 7 is a further modified form of the invention showing a weight actuated wedge that is loaded in a direction for generating horizontal restraint force on a lumber stack.

FIG. 6 shows a typical schematic representation of a scissor-type force generator for providing the edge to edge force F along the lateral sides of the lumber unit of stack, and the reaction force R as well. In FIG. 6, a kiln floor 69 is illustrated that supports rails 42. A conventional kiln car can be used to support the lumber pieces 13 held edge-to-edge and arranged in horizontal courses 11, and with spacers or stickers 15 between the courses. A kiln car is shown in FIG. 7.

Only selected courses of lumber are shown for convenience, but a full stack of lumber courses would be dried at a time. A quadrangle frame 63 having a base support 65, an upright reaction bar 65A, a removable second reaction assembly 67 is shown. The removable second reaction assembly 67 is removably secured to a tie bar 67A that connects to the top of reaction bar 65A. The removal of reaction assembly 67 opens the frame for loading lumber pieces on to base support 65. A full lumber unit is supported on the support 65. A plurality of the frames 63 can be used along the longitudinal length of lumber stack or unit 12.

The lateral or horizontal forces for clamping the narrow edges of the lumber pieces together are provided by loading push or force bars 71A and 71B. Scissor-type link force generators 73 are positioned on each of the lateral sides of the lumber stack 12 to actuate the push or force bars 71A and 71B.

The push bars 71A and 71B, as shown, are positioned to movably engage the individual lumber courses 11, to clamp the lumber pieces 13 edge to edge. The spacers or stickers 15 permit air circulation. The bars 71A and 71B have the scissor type force generators 73 pivotably connected thereto and spaced at desired vertical intervals, which can be selected according to the needs of the lumber and the force required.

The scissor type force generators 73 are each made up of a pair of links or arms 74A and 74B that are pivoted together at 74C, and the first art 74A of each force generator is pivoted to the respective upright frame members 65A and 67B. Upright frame member 67B is part of the removable reaction assembly 67. The second arm 74B of each force generator pivots on the respective force applying on push bar 71A and 71B.

In order to apply the horizontal clamping load, using the scissor force generators, a load-applying link 76 is pivoted at each of the pivots 74C, on all of the scissor force generators 73 utilized for applying the lateral forces on the lumber pieces. A suitable weight or mass 77 is attached to the interconnected links 76 on each side of the quadrangle frame 63 that will then apply a constant downward force tending to pivot the arms 74 and 74B, to cause the outer ends of the arms 74A and 74B to separate. A mechanical device (hydraulic cylinder, or a winch-like device that loaded the center pivots for example) can substitute for the suitable weight or mass 77 in generating the required downward force.

This force of separation of the ends of the links will apply a horizontal or lateral force onto the stack 12 of the lumber pieces 13 and the force will be substantially uniform as the lumber dries. The number of quadrangle frames 63 and push bars 71A and 71B used along the length of the stack or unit 20 of lumber can be selected as desired.

Additionally, the weight or mass 77 is mounted so that it will not touch the kiln floor, so that the horizontal force will be maintained throughout the drying process. The bars 71A and 71B can move inwardly to continue to apply lateral or horizontal clamping force.

By maintaining a lateral or horizontal clamping force on the unit of stickered lumber parallel to the plane of the courses of lumber, each of the individual lumber pieces 13 in each course is kept in edge to edge contact with the next adjacent lumber piece to prevent crook and other warp forms. A vertical force can be added to the lumber stack or unit by use of weight or other loading device to keep the wide side surfaces (width) in forced clamping contact with the stickers 15 as well, to further help prevent twisting and bowing. As the lumber pieces dry, the internal stresses that would tend to cause warping of some type are resisted by the lateral or horizontal forces, in particular, and thus warping is prevented.

FIG. 7 is a schematic end view of a further modified form of the invention. It is to be understood that the application of force can be from a number of longitudinally spaced frames such as that shown in FIG. 2. In this form of the invention, a kiln car 80 is positioned inside a heated kiln, having walls 82 or separate members that are capable of withstanding reaction forces. The kiln car 80 has wheels 80C supported on rails 80A on the kiln floor 80B and carries a lumber stack or unit 12 (the same number is used for the stack of lumber) comprising lumber pieces 13 arranged in courses 11, with stickers or spacers 15 between the courses 11. The kiln car 80 has pressure bars 84 on each side, that can be supported on the kiln car in a desired manner, but which are movable relative to the platform 86 of the kiln car 80. The bars 84 are able to move inwardly laterally against the edges of the courses 12 of lumber pieces to apply lateral or horizontal clamping force.

In this form of the invention, the force reaction walls 82 as shown have tapered interior surface 82A and 82B, respectively, on opposite sides of the lumber stack or unit 12. A weighted, wedge shaped, ram car 88A or 88B is provided on each side of the lumber stack or unit between the side walls surfaces 82A and 82B and the pressure bars 84. The wedge ram cars 88A and 88B have wheels that are shown at 90A and 90B, respectively, that ride against the inwardly sloped surfaces 82A and 82B and also roll against the outer surfaces of the pressure bars 84. The weight of the wedge ram cars 88A and 88B acting as a wedge provides a lateral or horizontal clamping force. By selecting the spacing between the surfaces 82A and 82B and the pressure bars 84, and the angle of inclination of the surfaces 82A and 82B, the initial position of the ram cars in vertical direction can be controlled. The weighted wedge ram cars will move down as the lumber pieces dry and shrink to keep edge to edge contact of the lumber pieces 13 in each course 11 and resist any crook as the lumber pieces dry and cool. Mechanical advantage can be used to assist downward movement of the ram cars 88A and 88B and also for raising the ram cars when needed. The pressure bars 84 are selected so they will apply clamping pressure along their lengths. The ram bars can be elongated more than shown herein and can have several sets of which to apply the force at desired locations along the pressure bars.

A top pressure panel or bar 94 can be provided as well, to exert a vertical load on the stack of lumber in a normal manner.

The wedge ram cars 88A and 88B can be heavy enough to provide not only a lateral force because of the wedge-type wall surfaces 82A and 82B, but through optional elastic tension loading members 96, provide a controlled weight that is transferred by the elastic tension members so it is applied to the top loading pressure bar 94 while permitting a needed portion of the weight from the wedge ram cars to continue to provide lateral or horizontal force.

These forces in both horizontal and vertical directions can be selected as required. The tension members 96 can also be eliminated so that the wedge ram cars 88A and 88B only load the lumber stack in lateral or horizontal direction. The pressure panel 94 at the top can be loaded in a conventional manner using a dead weight or mechanical force.

In order to provide the lateral or horizontal force, any suitable force generator for moving members against the outer sides of the lumber stack can be used in generally any lumber drying circumstance. The force generators can be air bags, pneumatic cylinders, hydraulic cylinders, mechanical (helical) springs or screw tacks. The wedge type rams shown in FIG. 7 also can be used to apply a horizontal force against the edges of the lumber pieces 13. The force generator is selected to continuously apply the restraining force as the lumber pieces dry.

Concrete weighting as a top load also can be used to provide a vertical force to restrain the lumber pieces 13 from twisting, bowing and cupping during the drying process. Various other weights can be utilized. There can be one or several force applying bars, walls, panels or columns along the length of the stack. The stickers 15 (or spacers) form planar channels 15A for air flow between the courses of lumber pieces. The air channels 15A have planes parallel to the planes of the courses made up of the plurality of lumber pieces. The force applied is in direction parallel to the plane of the lumber courses and the plane of the air flow channel between courses. This means the clamping forces are parallel to the surfaces of the lumber that are exposed to the drying air.

The individual quadrangle frames can be closed by bolt on brackets, or welded at selected joints to form an enclosure for conventionally stacked and stickered lumber. The load applying bars and reaction bars are directly opposite each other and offset laterally from the stickers.

In all forms of the invention, the concept is to maintain a horizontal lateral force on the stack or unit of lumber parallel to the courses of lumber pieces to maintain unyielding edge to edge contact of the lumber pieces as the lumber is dried.

The force applying mechanism ensures that the lumber pieces in each course are forced tightly, edge to edge to prevent warp, especially the manifestation of crook during the drying process and subsequent cooling or other post-drying treatment, collectively called lumber treatment. Application of dead weight or other loading on the top of the lumber stack will assist the horizontal force provided by the horizontal pressure bar in eliminating twist and bow of the lumber pieces, but is not needed in all cases. The need for vertically oriented loading may be dependent upon the species of the lumber.

The quadrangle frames with lumber in place for continuous restraint during drying and post-drying treatments can be used in a stand alone manner. However, the frames may be configured to rest one on top of another for two or more units of lumber stacked in a kiln or elsewhere. For vertical stacking of units in particular, all structural members must be correctly sized and designed to ably withstand the forces expressed in the context of the conditions used to dry the lumber and complete the overall processing. To maximize trouble free repetitious use of the quadrangle frames, all members are best made of suitable steel with properly welded joints wherever permissible and treated for rust resistance.

Although the present invention has been described with reference to preferred embodiments, workers skilled in the art will recognize that changes may be made in form and detail without departing from the spirit and scope of the invention.

What is claimed is:

1. A device suitable for supporting a stack of individual lumber pieces in a lumber treatment operation causing the lumber pieces to shrink during the treatment operation, wherein the lumber pieces are arranged in a stack of courses, each course comprising a plurality of the individual lumber pieces positioned edge to edge, the device comprising:

a generally horizontal base member adapted to support the stack of courses;

a generally upstanding rigid and moveable member adapted to engage at least portions of outer edges on one side of the stack of courses;

a generally upstanding rigid reaction member on a second opposite side of the stack of courses; and a horizontally extendible force generating member that engages the moveable member such that the moveable member is loaded with a substantially consistent selected horizontal force relative to and toward the reaction member, the force being applied to urge the movable member toward the reaction member continuously during the lumber treatment operation by extending the force generating member in a horizontal direction as a width of the lumber pieces shrink in order to maintain the substantially consistent selected force adapted to hold the lumber pieces in each course edge to edge continuously during the lumber treatment operation, the force being sufficient to prevent warpage in the lumber pieces during the lumber treatment operation.

2. The device of claim 1, wherein the lumber treatment comprises drying and further comprising spacers between the courses to permit air flow between the courses during the drying operation.

3. The device of claim 1, wherein the moveable member is loaded with a force generating mechanism mounted on one of the upstanding reaction members and the movable member.

4. The device of claim 3, wherein the force generating mechanism is a scissor link having arms coupled together at a pivot, wherein the arms separate when a vertical load is provided to the pivot and ends of the arms spread to apply the lateral force to the movable member.

5. The device of claim 4, wherein the force generating mechanism comprises a weight to apply the vertical load.

6. The device of claim 3, wherein the force generating mechanism is a fluid pressure piston.

7. The device of claim 4, wherein the reaction member is movable relative to the base member and a second scissor link engages the reaction member, wherein the second scissor link provides force relative to and toward the movable member.

8. The device of claim 5, wherein the links engaging the stack of courses are loaded under a downward force on the top of the stack of courses.

9. The device of claim 1 further comprising a force transfer mechanism to load the movable member including a wedge ram car disposed between a reaction wall and the movable member, the wedge ram car engaging the reaction wall and the movable member, the wedge ram car being movable relative to the support wall, wherein one of the reaction wall, the moveable wall and the wedge ram car has a tapered surface to provide a lateral force to the movable member when the wedge ram car is moved along the reaction wall.

10. The device of claim 1, wherein the lumber pieces have a width dimension greater than the edge dimension and moveable member is loaded with a force generating device acting to load the movable member against the edge dimension of lumber pieces in the courses continuously during the lumber treatment operation.

11. The device of claim 10, wherein the force generating device comprises a gaseous fluid expandable actuator.

12. The device of claim 9, wherein the wedge ram car has a weight comprising a force generating mechanism including the weight of the wedge ram car to move the wedge ram car along the reaction wall.

13. The device of claim 9, wherein the wedge ram car includes wheels engaging the reaction wall.

14. The device of claim 9, wherein the wedge ram car is coupled to a weight member to apply a downward force on the top of the stack of courses.

15. The device of claim 13, wherein the weight member is coupled to the wedge ram car with an elastic tension loading member.

16. The device of claim 10, wherein the movable member includes a plurality of spaced-apart pressure bars moved by the force generating mechanism.

17. A method of reducing warp in individual lumber pieces having edge surfaces and side surfaces during a lumber treatment operation that causes a change in at least a width of the lumber pieces, the method comprising:

arranging the individual lumber pieces in a stack of courses of lumber pieces, wherein each course includes a plurality of the lumber pieces positioned edge surface to edge surface, with the edge surfaces facing in a direction laterally of a vertical direction; and utilizing a horizontally extendible force generating member to maintain a substantially consistent clamping force on opposite lateral sides of the stack of courses generally perpendicular to the edge surfaces of the lumber pieces in each course to hold the lumber pieces edge surface to edge surface under the substantially consistent lateral clamping force during the entire lumber treatment operation by extending the force generating member in a horizontal direction to compensate for changes in dimensions of the lumber pieces in the courses of lumber pieces during the lumber treatment operation, wherein the clamping force is sufficient to prevent warpage of the lumber pieces during the lumber treatment operation.

18. The method of claim 17 including providing a space having a plane between the courses of lumber, the clamping force acting parallel to the plane of the space between lumber courses.

19. A loading device for courses of individual lumber pieces having a width and having edges having a height, in a lumber treatment operation that causes the lumber pieces to shrink, wherein the lumber pieces are arranged with the edges of adjacent lumber pieces side by side in at least one course of lumber pieces having a plane transverse to a vertical direction, the device comprising:

a support for the at least one course;

a rigid load member engaging at least portions of an outer side edge of a lumber piece at a first side of the at least one course;

a rigid and moveable reaction member on a second opposite side of the at least one course and supporting a side of a lumber piece at an opposite side of the at least one course against loads applied by the load member; and a laterally extendible force generator providing a clamping force to move the reaction member toward the load member, wherein the at least one course between the load member and reaction member is loaded in compression that is parallel to wide faces of the lumber pieces to maintain a substantially consistent selected force parallel to the plane of the at least one course to hold the lumber pieces in the at least one course edge to edge continuously under the selected force during the lumber treatment operation, the load member and the reaction member thereby moving together by extending the force generator in a horizontal direction as the lumber pieces shrink, wherein the clamping force is sufficient to prevent warpage during the lumber treatment operation.

20. The loading device of claim 19, wherein at least one of the load members and reaction members is movable, and the force generator comprises a fluid pressure actuator.

21. The loading device of claim 19 wherein the lumber treatment operation comprises drying the lumber pieces, and a second force generator providing a vertical force on the at least one course during the drying of the lumber pieces.

* * * * *